US007665536B2

(12) United States Patent
Patel

(10) Patent No.: US 7,665,536 B2
(45) Date of Patent: Feb. 23, 2010

(54) SYSTEM AND METHOD FOR PREVENTING CROSS-FLOW BETWEEN FORMATIONS OF A WELL

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 878 days.

(21) Appl. No.: 10/710,753

(22) Filed: Jul. 30, 2004

(65) Prior Publication Data

US 2006/0021757 A1 Feb. 2, 2006

(51) Int. Cl.
*E21B 43/14* (2006.01)
*E21B 43/12* (2006.01)
*E21B 34/10* (2006.01)

(52) U.S. Cl. ..... 166/386; 166/319; 166/332.8; 166/374; 166/191

(58) Field of Classification Search ..... 166/386, 166/319, 321, 332.8, 313, 374, 191
See application file for complete search history.

(56) References Cited

U.S. PATENT DOCUMENTS 5,271,462 A * 12/1993 Berzin ..... 166/191
5,823,265 A 10/1998 Crow et al.
5,862,865 A * 1/1999 Murray et al. ..... 166/373
6,227,298 B1 * 5/2001 Patel ..... 166/321
6,328,109 B1 12/2001 Pringle et al.
6,668,935 B1 12/2003 McLoughlin et al.
6,668,936 B2 * 12/2003 Williamson et al. ..... 166/375
6,997,263 B2 * 2/2006 Campbell et al. ..... 166/374
2002/0023746 A1 * 2/2002 Ringgenberg et al. ..... 166/55

* cited by examiner

*Primary Examiner*—Jennifer H Gay
*Assistant Examiner*—B. Harcourt
(74) *Attorney, Agent, or Firm*—Daryl R. Wright; Rodney Warfford; Van Someren, PC

(57) ABSTRACT

In general, a system and valve is provided to prevent the cross flow between formations during the shut-in period of a well intersecting at least two formations, with flow from at least one of the formations being controlled by a multi-position valve. In one embodiment, the system comprises a cross-flow prevention valve that automatically closes and then opens during each cycle of the multi-position valve. In another embodiment, the cross-flow prevention valve is activated by the same control line used to activate the multi-position valve.

5 Claims, 2 Drawing Sheets

SYSTEM AND METHOD FOR PREVENTING CROSS-FLOW BETWEEN FORMATIONS OF A WELL

BACKGROUND OF INVENTION

It is common for wells to intersect multiple zones, with each zone being subject to independent flow control via a flow control valve deployed on a tubing. In some cases, the valves used in the tubing are multi-position valves that have a number of partially open positions between fully open and fully closed.

Unfortunately, wellbores are sometimes unexpectedly shut-in (either automatically or based on a user's actions) as a result of the occurrence of certain events. If two or more valves in the wellbore are left open after the well is shut-in, then a potential for cross-flow exists between the two or more formations that correspond to the open valves. Cross-flow between formations is sometimes undesired and/or illegal.

The problem is compounded when the valves take a substantial amount of time to be activated or cycled to the fully closed position. In certain situations, time is critical in preventing any potential for cross-flow.

The problem is further compounded in injection wells. In these wells, cross-flow during shut-in can lead to the flow of solid fine particles and/or sand from one formation to another. When an operator is ready to begin injection once again, the solid fine particles that have passed between formations often minimize the injection rate into the target zone since they tend to plug the microholes associated with the target zone.

SUMMARY OF INVENTION

In general, a system and valve is provided to prevent the cross flow between formations during the shut-in period of a well intersecting at least two formations, with flow from at least one of the formations being controlled by a multi-position valve. In one embodiment, the system comprises a cross-flow prevention valve that automatically closes and then opens during each cycle of the multi-position valve. In another embodiment, the cross-flow prevention valve is activated by the same control line used to activate the multi-position valve.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
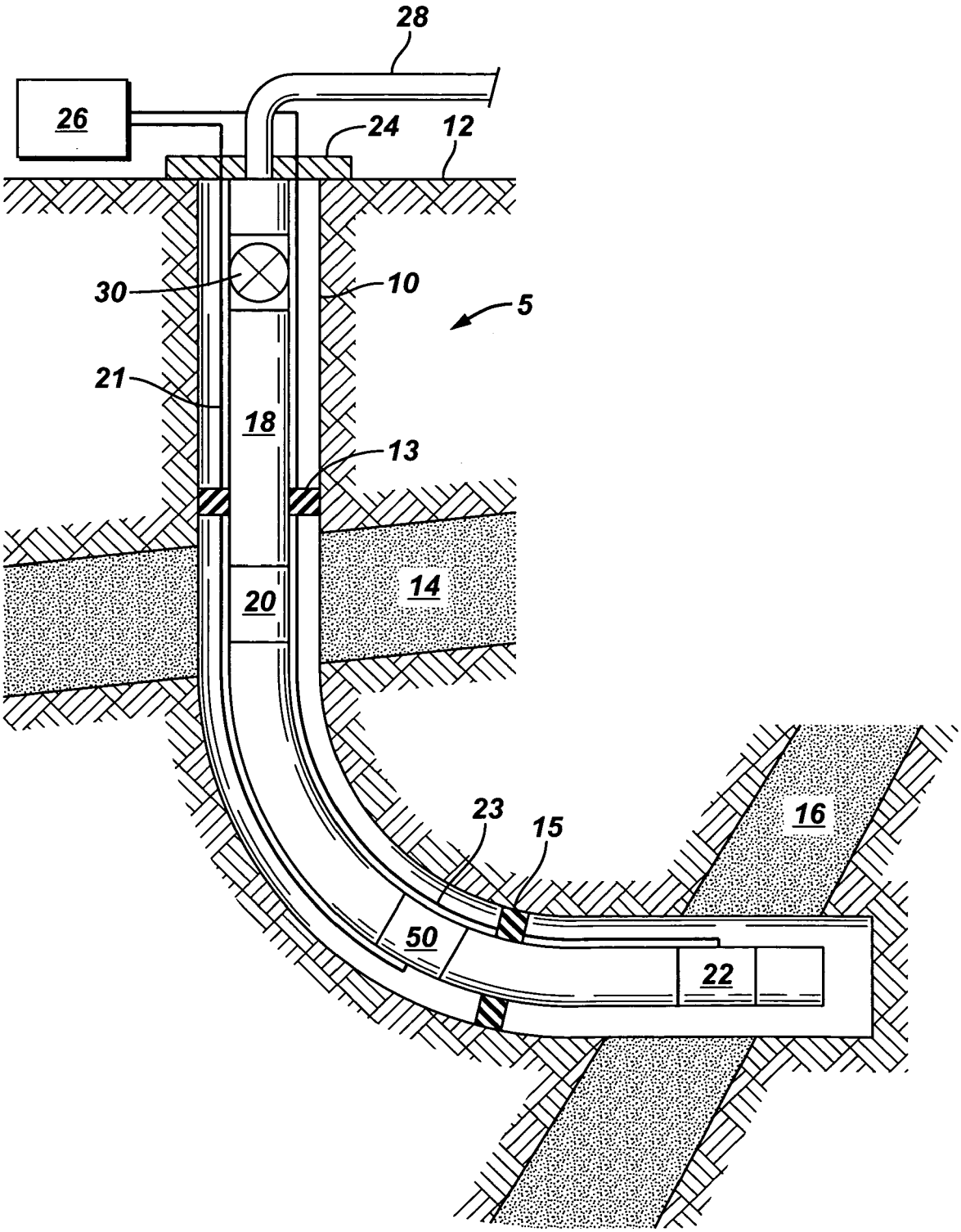
FIG. 1 illustrates the system of the present invention including at least one multi-position valve and a cross-flow prevention valve.

FIG. 1 shows a wellbore 10 that extends from the surface 12 downhole and through two formations 14, 16. Wellbore 10 may be a land well, in which case surface 12 is the land surface, or a subsea well, in which case surface 12 is the ocean bottom. Wellbore 10 may be cased or uncased and may intersect more than two formations. A tubing 18, which may comprise production, drilling, or coiled tubing, is deployed in the wellbore 10. Packer 13 may isolate formation 14 from the surface 12, and packer 15 may isolate the formations 14, 16 from each other. A safety valve 30 is selectively activated to shut-off flow through tubing 18.

A flow control valve 20 is attached to the tubing 18 to control the flow from formation 14. A flow control valve 22 is attached to the tubing 18 to control the flow from formation 16. In one embodiment, flow control valves 20, 22 are multi-position valves that have at least one position between fully open and fully closed. The valves 20, 22 may be a sleeve valve, a disc valve, a flapper valve, or a ball valve, among others. Also, in one embodiment, the flow control valves 20, 22 are hydraulically activated via a hydraulic control line 21, 23. An exemplary flow control valve is described in commonly-owned U.S. Pat. No. 6,668,935 and US 2004/108116, which patent and application are incorporated herein by reference. Although both of the valves 20, 22 can be actuated using one control line, FIG. 1 shows each of the valves being actuated via and connected to a separate control line 21, 23. The control lines 21, 23 are typically mechanically connected to the tubing 18, such as by the use of clamps (not shown), and extend through the wellhead 24 and to a hydraulic pressure source 26 (such as a pump). The control lines 21, 23 also extend through by-pass ports in packers 13, 15.

An operator controls the pressure source 26 to pressurize the control lines 21, 23 to activate the valves 20, 22. In one embodiment, the valves 20, 22 are constructed so that one pressure cycle in the corresponding control line 21, 23 shifts the valve between two of its positions. A "pressure cycle" may be defined as raising the pressure in a control line to a given pressure rate and then lowering the pressure to the starting rate. Therefore, for instance, one pressure cycle in a control line may shift a valve from fully closed to 10 percent open. Or, one pressure cycle in a control line may shift a valve from 50 percent open to 75 percent open. The positions and sequence of positions that may be selected for each valve of course depend on the construction and configuration of the valve, as desired by the user.

If wellbore 10 is a producing wellbore, hydrocarbons flow from the formations 14, 16 into the wellbore 10 (such as through perforations, if required) and into the tubing 18 through the corresponding valve 20, 22 (provided such valve 20, 22 is in an open position). The hydrocarbon fluid flow continues up the tubing 18 and to the surface 12, where it is communicated elsewhere by a pipe 28.

If wellbore 10 is an injection wellbore, fluid is injected from the surface 12 and into tubing 18. If any of the valves 20, 22 is open, fluid flows through the open valve 20, 22 and into formation 14, 16. The injected fluid may comprise water (for water injection) or treatment fluid (such as fracking or other chemical treatment fluid used to enhance the production from or injection into a formation).

As previously discussed, wellbores are sometimes unexpectedly shut-in (either automatically or based on a user's actions) if certain events occur downhole. For instance, if a leak occurs at the wellhead or elsewhere, the wellbore 10 is shut-in, such as by closing safety valve 30 and thereby preventing flow through tubing 18. If valves 20, 22 are left in an open position after the wellbore 10 is shut-in, a potential for cross-flow exists between the formations 14, 16. For example, if formation 16 has a higher pressure than formation 14, then fluid may flow from formation 16, into wellbore 10, through open valve 22, through tubing 18, through valve 20, and into formation 14.

The present invention comprises a cross-flow prevention valve 50 that is incorporated into the overall system 5 and prevents the flow between formations 14, 16 when the wellbore 10 is shut-in. Generally, valve 50 is selectively closed when the wellbore 10 is shut-in. In one embodiment, valve 50 is a hydraulically actuated valve. In another embodiment, valve 50 is hydraulically activated by the same control line 21 used to control valve 20.

Figure 2:
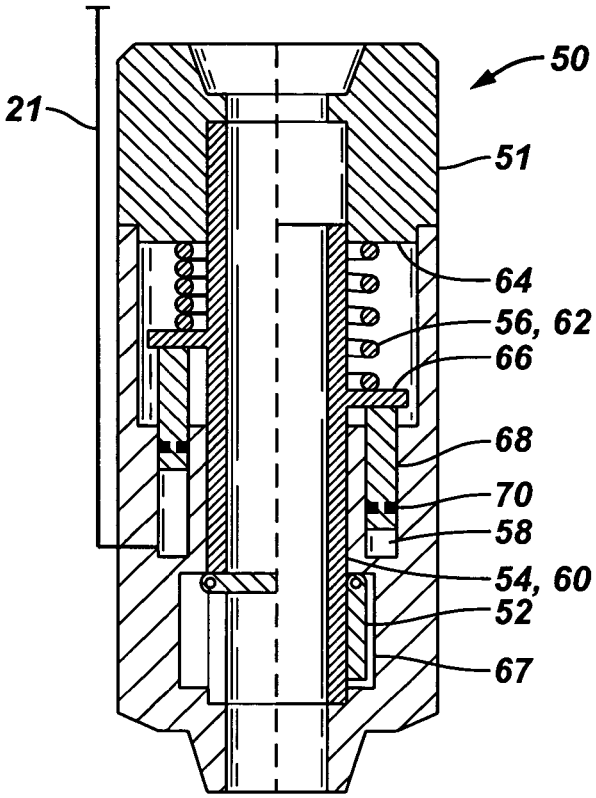
FIG. 2 shows one embodiment of the cross-flow prevention valve.

FIG. 2 shows one embodiment of the valve 50. Note that the right side of FIG. 2 shows valve 50 in the open position, while the left side of FIG. 2 shows valve 50 in the closed position. In this embodiment, valve 50 is a flapper type valve that comprises a mandrel 51, a flapper 52, an activator 54, a biasing mechanism 56, and a selectively pressurized chamber 58. Control line 21 is in fluid communication with chamber 58 through the exterior of mandrel 51. Activator 54 preferably comprises a flow tube 60 slidably disposed within mandrel 51. Flapper 52 is hingedly connected to mandrel 51 so that it can pivot between an open position (see right side of FIG. 2) and a closed position (see left side of FIG. 2). Flapper 52 is constructed so that it is internally biased to the closed position (left side of FIG. 2) absent application of external force. In the open position, flapper 52 is housed within an opening 67 of mandrel 51. Flow tube 60 is slidable between a position that pivots flapper 52 to the open position (left side of FIG. 2) and a position that pivots flapper 52 to the closed position (right side of FIG. 2). In the closed-flapper position, flow tube 60 places a very small, if any, force on flapper 52 thereby allowing flapper 52 to bias itself to the closed-flapper position. In the open-flapper position, flow tube 60 is extended through flapper 52 so that flapper 52 is pivoted to its open position. Biasing mechanism 56 can, in one embodiment, comprise a spring 62 disposed between a mandrel surface 64 and an activator edge 66.

In the embodiment of FIG. 2, flapper valve 50 also comprises at least one rod piston 68 disposed in mandrel 51. At least one seal 70 is disposed on each piston 68 providing a seal against mandrel 51. Each piston 68 is connected to the activator edge 66 and is exposed to the chamber 58 so that pressure differentials between the activator edge 66 and the chamber 58 are transmitted across piston 68 (and seals 70).

When chamber 58 is not pressurized via control line 21, the force in spring 62 and the force due to the internal tubing pressure acting on one side of the piston 68 is higher than the force in chamber 58 due to the fluid column in the control line 21, and the spring 62 therefore biases/slides flow tube 60 (through the piston 68/activator edge 66 connection) in the direction of flapper 52 causing the flapper 52 to pivot to its open position as shown on the right side of FIG. 2. However, when the chamber 58 is pressurized to a force higher than the force of spring 62 and the force due to the internal tubing pressure acting on one side of the piston 68 (by pressurizing control line 21 through pressure source 26), the force in chamber 58 overcomes the force in spring 62 and the force due to the internal tubing pressure acting on one side of the piston 68 and flow tube 60 slides away from flapper 52 (through the piston 68/activator edge 66 connection) allowing flapper 52 to bias itself to the closed-flapper position as shown on the left side of FIG. 2.

In the embodiment in which cross-flow prevention valve 50 is activated via the same control line 21 as that used to activate flow valve 20, it is understood that each pressure cycle of the flow valve 20 results in the cross-flow prevention valve 50 cycling between an open to closed to open position. For instance, in the static position and also as the system 5 is deployed downhole, no pressure is applied in control line 21. Therefore, the spring 62 force overcomes the force in the chamber 58 and flow tube 60 is biased to pivot flapper 52 to its open position. When the control line 21 is pressurized to activate the flow valve 20, the pressure in chamber 58 also increases and overcomes the spring 62 force thereby biasing the flow tube 60 away from the flapper 52 and allowing the flapper 52 to bias itself to the closed position. This position is maintained, and cross-flow between formations 14, 16 is therefore prevented, when flapper 52 is in this closed position, regardless of the state of flow valves 20, 22 and even if flow valves 20, 22 are both in an open position. When the control line 21 is once again depressurized, the pressure in chamber 58 also decreases thereby enabling the spring 56 force to bias the flow tube 60 to pivot flapper 52 back to its open position. It is understood that, as previously disclosed, a pressure cycle of flow valve 20 as described also results in a shift between positions of flow valve 20.

It is also noted that although the operation of the cross-flow prevention valve 50 is described as being linked to the flow valve 20 through control line 21, the operation of the cross-flow prevention valve 50 may be linked to any other flow valve in the wellbore 10 (such as flow valve 22) through any control line. In the embodiment in which cross-flow prevention valve 50 is actuated by its independent control line (not shown), the procedure is the same as discussed above, except that it is not interlinked with the actuation of the flow valve 20.

It is noted that the system 5 can be used with only one flow valve 20 or 22 (instead of two) and a cross-flow prevention valve 50. In this case, one of the formations 14 or 16 is controlled via the deployed flow valve 20 or 22, but fluid into or from the other formation 14 or 16 is free flowing into or out of the tubing 18 through for instance a ported tubing. The cross-flow prevention valve 50 would still prevent cross-flow between the formations 14 and 16 should the wellbore 10 be shut-in or should the need arise.

Figure 3:
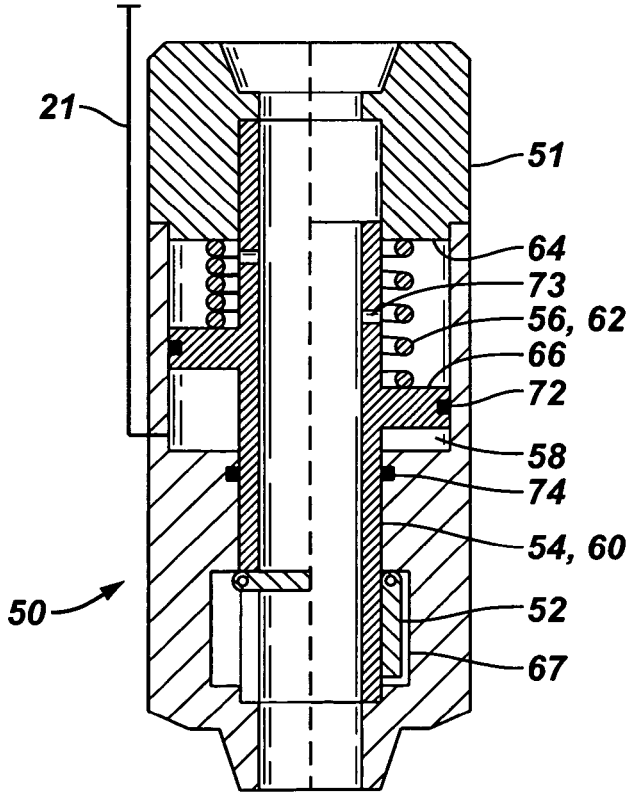
FIG. 3 shows another embodiment of the cross-flow prevention valve.

FIG. 3 shows another embodiment of valve 50. As in FIG. 2, the right side of FIG. 3 shows valve 50 in the open position, while the left side of FIG. 3 shows valve 50 in the closed position. The embodiment of FIG. 3 is similar to the embodiment of FIG. 2 (and like numbers represent like components), except that the rod pistons 58 used in the embodiment of FIG. 2 are not used in the embodiment of FIG. 3. As shown in FIG. 3, the activator edge 66 of the activator 54 acts as the rod piston 58 and all pressure differentials between spring 62 and chamber 58 are transmitted through the activator edge 66. In order to enable such transmission, activator edge 66 includes seals 72 that seal against mandrel 51, activator 54 includes a pressure-equalization passage 73 therethrough providing fluid communication (and pressure equalization) between the area surrounding the spring 62 and the interior of the activator 54, and a further seal 74 sealing the activator 54 to the mandrel 51 is included intermediate the chamber 58 and the flapper 52 (to enable the pressurization of chamber 58). Chamber 58 is therefore located intermediate the seals 72, 74 and the control line 21 is in fluid communication through the mandrel 51 to such location. The valve 50 embodiment of FIG. 3 operates the same way as the valve 50 embodiment of FIG. 2.

It is noted that the use of a flapper type valve for valve 50 enables the injection of fluid through the tubing 18 as desired by the operator, even if the flow valve is in the middle of position cycle or if the well is shut-in and the cross-flow prevention valve 50 is in the closed position. For instance, if the valve 50 is in the closed position (see left sides of FIGS. 2 and 3), an operator may inject fluid into the tubing 18. As long as the pressure at which the fluid is injected is higher than the self-bias of the flapper 52, the fluid will act to pivot the flapper 52 to its open position.

In operation, the system 5, including at least one flow valve 20 and a cross-flow prevention valve 50, are deployed in the wellbore 10. The flow valve 20 controls communication to a formation 14. Communication from another formation 16 may be controlled by another flow valve 22. The flow valves 20, 22 are hydraulically activated via their respective control lines and cycle, as desired by the operator, between open, partially open, and closed positions. If the well is shut-in and an operator wishes to prevent cross-flow between formations, the operator can simply maintain the pressurization of the cross-flow prevention valve 50 control line, which action maintains valve 50 in the closed position preventing cross-flow between formations 14, 16. This cross-flow prevention is maintained, regardless of the state of flow valves 20, 22. The steps taken to operate the system 5 as described herein also disclose a method by which to prevent cross-flow between formations.

While a flapper type valve is illustrated herein, it is understood that many other types of valve may be used in place of the flapper type valve. For instance, cross-flow prevention valve 50 may also comprise a sleeve valve, a ball valve, or a disc valve, among others. Any of the abovementioned valves could seal either from one or both directions (uphole and downhole directions). The ability to seal in both directions may be required depending on the circumstances of the particular wellbore, such as when the wellbore is a producing wellbore with multiple producing formations.

While the present invention has been described with respect to a limited number of embodiments, those skilled in the art, having the benefit of this disclosure, will appreciate numerous modifications and variations therefrom. For instance, the present invention may be installed in a land as well as a subsea wellbore. It is intended that the appended claims cover all such modifications and variations as fall within the true spirit and scope of this present invention.

The invention claimed is:

1. A system for preventing cross-flow between at least two formations intersecting a wellbore, comprising:

a first multi-position flow valve controlling the flow from a first formation;

a second multi-position flow valve controlling the flow from a next adjacent active formation; and a cross-flow prevention valve disposed between the first multi-position flow valve and the second multi-position flow valve to selectively prevent flow between the first formation and the next adjacent active formation.

2. The system of claim 1, wherein the cross-flow prevention valve comprises a flapper valve, and the flow valve and the flapper valve are actuated with the same hydraulic control line.

3. The system of claim 2, wherein the flapper valve is actuated and the flow valve is shifted from one to another position with each pressure cycle in the hydraulic control line.

4. The system of claim 2, wherein the flapper valve is self-biased to a closed position when a hydraulic control line operatively connected to the flapper valve is pressurized below a certain pressure.

5. The system of claim 4, wherein the flapper valve is moved to an open position when the pressure in the hydraulic control line is above a certain pressure.

* * * * *